United States Patent [19]

Dorsen et al.

[11] 4,177,587

[45] Dec. 11, 1979

[54] NAME PLATE ASSEMBLY FOR TOTE BAG AND THE LIKE

[75] Inventors: Mac Dorsen, Scarsdale; Philip A. Saltzman, Brooklyn, both of N.Y.

[73] Assignee: Stupell Industries, Inc., Providence, R.I.

[21] Appl. No.: 819,682

[22] Filed: Jul. 27, 1977

[51] Int. Cl.[2] ..... G09F 3/20

[52] U.S. Cl. ..... 40/16; 40/10 D; 40/21 C; 40/159; 40/314; 40/594

[58] Field of Search ..... 40/16, 5, 6, 16.4, 10 R, 40/10 D, 490, 489, 594, 595, 314, 19, 21 C, 159, 586

[56] References Cited

U.S. PATENT DOCUMENTS

| | | | |
|---|---|---|---|
| 1,678,621 | 7/1928 | Holmes | 40/490 X |
| 2,231,364 | 2/1941 | Mainzer | 40/19 X |
| 2,297,285 | 9/1942 | Bledsoe | 40/10 D X |
| 2,353,328 | 7/1944 | Winston | 40/10 R |
| 2,801,477 | 8/1957 | Adams et al. | 40/159 X |
| 2,925,675 | 2/1960 | Lumpkin | 40/16 X |
| 3,440,746 | 4/1969 | Richards | 40/595 |

FOREIGN PATENT DOCUMENTS

| | | | |
|---|---|---|---|
| 711639 | 7/1954 | United Kingdom | 40/314 |

*Primary Examiner*—John F. Pitrelli
*Attorney, Agent, or Firm*—Salter & Michaelson

[57] ABSTRACT

An article such as a tote bag is provided with an identifying indicia assembly including a generally transparent pocket of closed construction except for a slotted opening formed at one side thereof for receipt of a thin generally transparent material strip. The pocket, or at least the outer face thereof, is also generally transparent so that individual letters may be adhesively secured to the front face of the strip and be visible through the pocket. The article to which the pocket is secured may thus be personalized. Such articles may include tote bags, purses, combs, and the like.

3 Claims, 9 Drawing Figures

NAME PLATE ASSEMBLY FOR TOTE BAG AND THE LIKE

BACKGROUND OF THE INVENTION

This invention is directed to a means for personalizing or otherwise providing various articles with identifying indicia. More particularly, the invention is directed to means by which personal care and fashion orientated articles, including tote bags, may be personalized by the application of names or initials thereto in a manner that such indicia may be purchased in kit form and then the desired initials or the like conveniently and easily assembled and mounted by the user.

It is generally known, in fact common, to personalize or otherwise identify all kinds of articles by the application of indicia thereto. Common examples of such are the initials attached to luggage as by adhesive connection, name plates attached as by sewing to articles of clothing, etc. Such methods and the devices used for their attachment generally contemplate either the direct attachment of the identifying material to the article or attachment in such a manner that the indicia is either not removable or, if so, is not capable for ready reuse at a later time. There thus exists a need for a means by which various personalized indicia may be applied, especially to fashion articles including the presently popular tote bags and the like, so that such can be easily and readily applied to the article. It would also be desirable for such indicia to be simply removable and other similar identification easily substituted therefor.

It is accordingly a primary object of the present invention to provide a device of the aforementioned type in which identifying indicia may be applied to an article in such a manner that it may be easily removed and utilized for subsequent reuse.

A further object of the invention is the provision of a device of the immediately aforementioned type which may be easily secured to an article in a reasonably secure fashion but which may be similarly easily removed therefrom for subsequent reuse or replacement.

These and other objects of the present invention are accomplished by the use of an intermediate material strip adapted to receive individual indicia forming elements, each such element having an adhesive backing thereon. The elements are accordingly adhesively connected to the strip which in turn is positioned within receiving means in turn interconnected or forming a part of the article. The receiving means generally is in the form of a pocket having a front face which is at least translucent so that the indicia placed upon the strip received therein may be readily observed.

Other objects, features and advantages of the invention shall become apparent as the description thereof proceeds when considered in connection with the accompanying illustrative drawings.

In the drawing which illustrates the best mode presently contemplated for carrying out the present invention:

DESCRIPTION OF THE INVENTION

Figure 1:
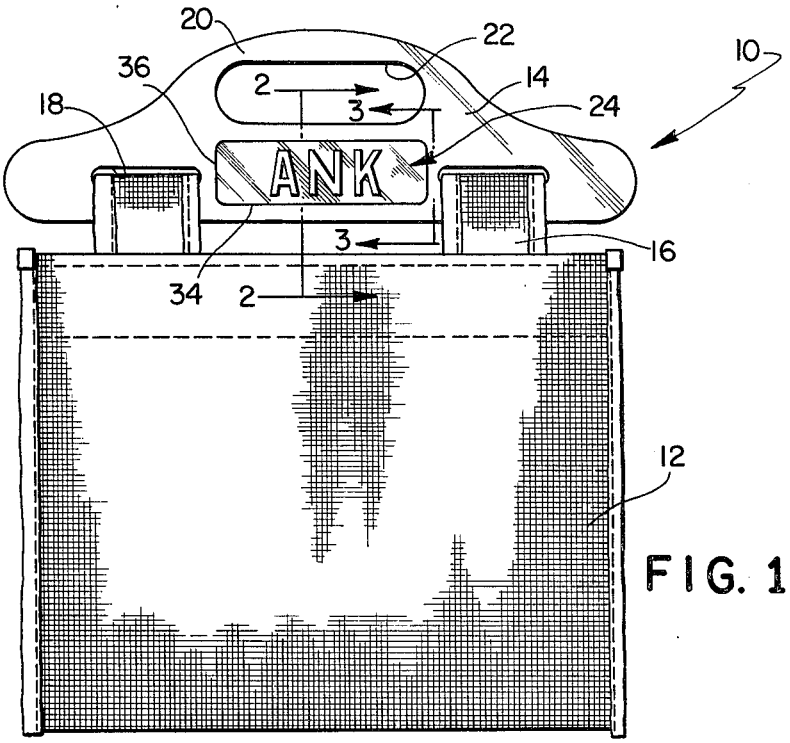
FIG. 1 is a front elevational view of a tote bag incorporating the present invention whereby identifying indicia is applied thereto in accordance with such invention.
Figure 2:
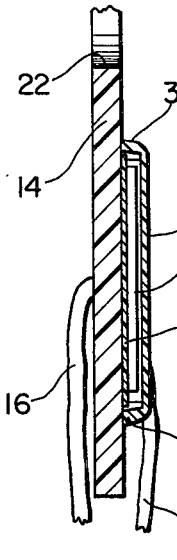
FIG. 2 is a side sectional view of a portion thereof taken along the line 2—2 of FIG. 1.
Figure 3:
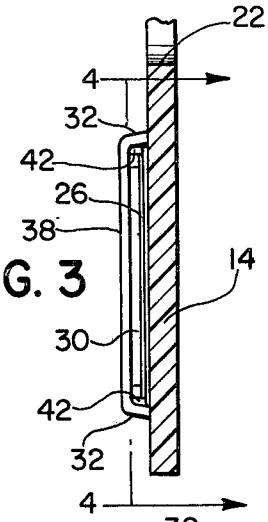
FIG. 3 is a side sectional view similar to FIG. 2 but taken along the line 3—3 of FIG. 1.
Figure 5:
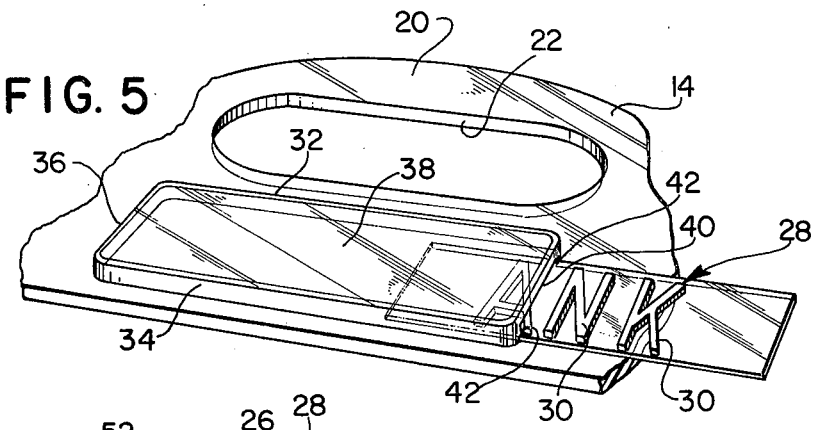
FIG. 5 is a partial perspective view of such handle provided with means for identifying the tote bag of FIG. 1.
Figure 7:
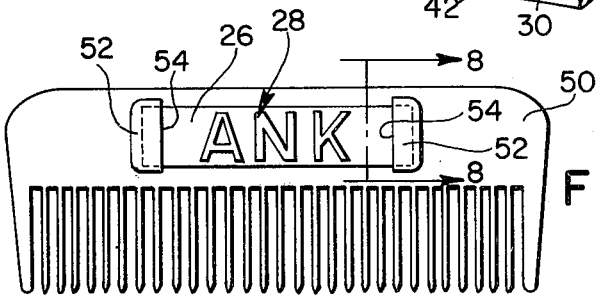
FIG. 7 is an elevational view of a modified constructional form which the present invention may take.
Figure 4:
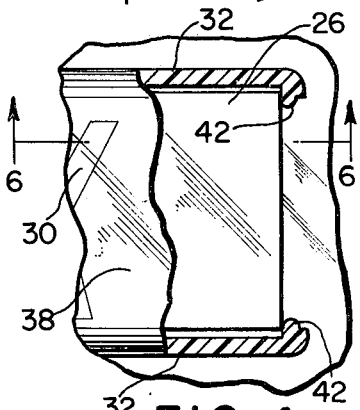
FIG. 4 is a partial side sectional view of a portion of the handle in part forming the tote bag shown in FIG. 1.
Figure 9:
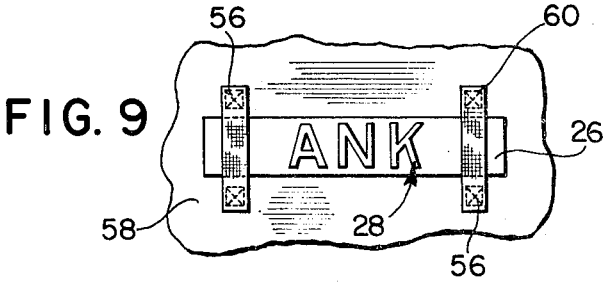
FIG. 9 is still another constructional embodiment which the present invention may take.
Figure 6:
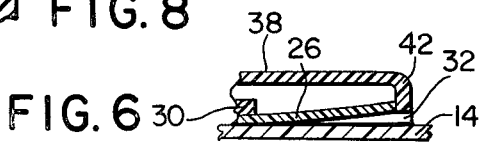
FIG. 6 is a partial sectional view taken along the line 6—6 of FIG. 4.

The present invention is adapted for use with an unlimited number of articles; however, as illustrative of such articles a handled tote bag, a comb and a textile article such as a garment are respectively illustrated in FIGS. 1, 7 and 9. It should be pointed out that these illustrated forms are by way of example and not by way of limitation.

Turning now to the drawing and particularly FIG. 1 thereof, a tote bag 10 is illustrated. Such bag includes a pouch or sack 12 generally formed from canvas material with which one or a side-by-side pair of handles 14 may be secured, as by means of loops 16 passing through openings 18 formed within the handle or handles and thence affixed to an opposite side of the pouch as by snap fasteners (not shown). The handle or handles 14 generally further include a grip 20 so that the tote bag 10 may be grasped and carried as by projection of the user's fingers through the opening or openings 22.

In order to identify the owner, or convey other pertinent messages such as popular sayings and the like to those who may observe the tote bag or other article during use, one or both of the handles 14 is provided with a structure or means 24 for receiving a generally thin material strip 26 upon which indicia 28 may be adhered. The strip 26 is generally formed of thin flexible plastic material which may be translucent, or transparent or colored. In any case, the strip 26 is of a color, appearance, or texture such that the indicia 28 adhered thereto will contrast therewith and be accordingly visible when displayed within the structure or receiving means 24. Generally the indicia 28 includes a plurality of individual identifying elements 30 which may be letters, numbers, symbols or the like and having an adhesive coating at the rear surface thereof. Accordingly by proper placement and attachment to the strip 26, various initials, words and messages may be spelled out thereon. Preferably, the adhesive material on the rear surface of each of the elements 30 is such that these elements may be repeatedly adhered and removed from the strip 26 although such is not a requirement of the present invention inasmuch as a plurality of such strips may be utilized so that varying indicia may be placed on such strips and the strips thereafter alternatively used in conjunction with the articles, such as the tote bag 10, to vary the personalization thereof in accordance with the mood or occasion of the user.

The receiving means 24 is generally in the form of a pocket having opposed top and bottom walls 32 and 34 respectively outwardly projecting from the surface of the handle 14. A similarly orientated side wall 36 is further provided and an outer face 38 is connected to such walls so as to form the overall structure of the pocket. The opposite side of the structure 24 includes an open slot 40. The height of the slot is adequate to receive the combined height of the strip 26 and the indicia elements 30. The lateral extent or width of the slot 40 at the base or bottom thereof is defined by the spacing of the top and bottom walls 32,34 respectively, but at upper portions thereof such spacing is reduced by the presence of bosses 42 inwardly projecting from such walls 32,34 and accordingly narrowing the slot width in such locations. The width of such slot at lower portions thereof where it is of full extent is equal to or slightly larger than the width of the material strip 26. At upper portions of the slot, the presence of the bosses 42 reduces such width to a dimension at least slightly smaller than the width of such strip 26. Generally the slot aside from the presence of the bosses 42 is unaltered, i.e. it is centrally open, and the bosses do not extent inwardly a significant degree except as hereinafter pointed out. In this way, then, when the strip 26 is introduced into the slot 40 at lower portions thereof, it is free to move thereinto until restrained by the side wall 36. The length of the strip 26 is also slightly smaller than the distance between the inner surfaces of the side wall 36 or the bosses or abutments 42. When the strip with the indicia 28 is placed within the pocket formed by the receiving means 24, that end thereof which is to be disposed proximal to the slot 40 is slightly upwardly bent or curled so that after the strip enters the pocket, its full extent, such end will upwardly extend and abut the bosses 42. In this manner, then the strip 26 is retained within the pocket in a reasonably secure fashion; however, if it is desired to remove such, as for replacement with a similar strip having other indicia, a thin object may merely be inserted centrally of the slot 40 above the strip and with a downward movement frictionally urge that end of the strip outwardly of the slot 40 at the full width lower portion thereof.

Turning now to FIG. 7 of the drawing, an altermate embodiment is depicted wherein a comb 50 is provided with members 52 at spaced locations at one side thereof. Each of the members 52 is of generally closed configuration forming pockets, the entrance to such pockets being in opposed spaced relation to each other. A strip 26 similar to that referred to in regard to the FIGS. 1–6 embodiment and similarly having indicia 28 thereon is adapted for receipt within such members 52, it being clear that the indicia 28 thereof is disposed centrally so as to be visible and so as to not interfere with the entrance of opposite ends of the strip 26 into the pockets of the members 52. Inasmuch as the strip 26 is flexible, it may be bent across its longitudinal axis so as to foreshorten the ends thereof and accordingly enable such ends to be received within the slots 54 provided in opposed sides of the members 52. The vertical extent or height of such slots 54 is slightly greater than the height or thickness of the strip 26 and materially less than the combined height of such strip and individual elements 30.

Figure 8:
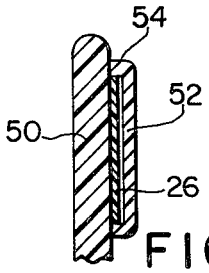
FIG. 8, is a side sectional view taken along the line 8—8 thereof.

Turning now to FIG. 9 of the drawing, a further embodiment of the present invention is disclosed wherein the receiving means for the strip 26 and its associated indicia 28 is in the form of a pair of spaced loops 56 attached to an article such as a fabric garment 58 by means of sewing, as indicated by connections 60. The loops are of a vertical, i.e. lateral extent, such that the space between their opposed points of connection 60 is large enough to permit access of the strip 26. In such case the strip may be either inserted longitudinally and sequentially through both of the loops 56, or as in the previous cases explained with the FIGS. 7 and 8 embodiment, may be bent and thereafter each end thereof simultaneously inserted within the spaced loops 56.

It is contemplated that the strip 26 will be sold as a part of a kit also containing a complete selection of adhesive initials or other indicia whereby the user may purchase such a kit, select the desired initials or indicia, adhere same to the strip, and then mount the strip on the article with which it is to be used in any of the aforedescribed methods of assembly.

While there is shown and discribed herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An article having identifying indicia thereon, said article including means for releasably receiving an elongated generally thin material strip, said strip having a front face adapted for the receipt of marking indicia adhered thereto, said receiving means in turn attached to said article whereby a plurality of material strips may be alternatively received by said receiving means so as to modify the indicia of said article, said receiving means adapted to contact said strip at least at two longitudinally spaced locations thereof, said marking indicia positioned on said strip between said locations, said article receiving means comprising a substantially enclosed substantially rigid pocket outwardly projecting from said article, one side thereof open for receipt of said strip therein for underlying relationship with the outer face of said pocket, said outer face at least translucent so that at least the indicia on said strip is visible therethrough, said strip being flexible and having its opposed ends normally upwardly curled, said pocket having a top wall, a bottom wall, and a side wall, said walls outwardly extending from said article and connected to said outer face so as to space said outer face from said article, an (said) open side opposed to and longitudinally spaced from said side wall and defining a narrow slot for receipt of said strip said slot having a bottom portion adjacent said article, said slot being of sufficient width at said bottom portion for the uninterrupted receipt of said strip but narrower than the width of said strip at upper portions thereof whereby said normally upwardly bent portions of said strip end proximal said slot (will) abut said upper portions thereof so as to retain said strip within said pocket, said slot upper portions being formed by a pair of opposed bosses inwardly extending into said slot from top and bottom walls of said pocket.

2. The article of claim 1, said strip being a flexible, transparent plastic material, said marking indicia being individual colored elements having an adhesive backing whereby one or more of said elements may be adhesively connected to the front face of said strip so as to form said indicia.

3. The article of claim 1, said strip adapted to contact said pocket side wall at one end thereof and said upper portions of said slot at the other end.

* * * * *